United States Patent [19]

Richardson

[11] 4,174,848

[45] Nov. 20, 1979

[54] LATCHING MECHANISM FOR RECIPROCATING IMPACT TOOLS

[75] Inventor: Victor E. Richardson, Houston, Tex.

[73] Assignee: Dresser Industries, Inc., Dallas, Tex.

[21] Appl. No.: 882,474

[22] Filed: Mar. 1, 1978

[51] Int. Cl.[2] ..... B25D 17/08

[52] U.S. Cl. ..... 279/19.5

[58] Field of Search ..... 279/19.5, 19, 76

[56] References Cited

U.S. PATENT DOCUMENTS 2,716,393 8/1955 Fischer ..... 279/19.5

*Primary Examiner*—Gil Weidenfeld

*Attorney, Agent, or Firm*—Roy L. Van Winkle; John N. Hazelwood

[57] ABSTRACT

An improved latching mechanism for retaining bits, such as chisels, chippers or scalers in reciprocating impact tools. The improved latching mechanism includes a latch member that is located in the hollow nose of the tool and is rotatable between latched and unlatched positions. A split spring encircles the nose and engages the latch member to prevent inadvertent rotation of the latch member and to retain the latch member in the nose. The latch member extends into the hollow nose and, when in the latched position, engages the bit to retain the bit in the tool while permitting limited reciprocating movement of the bit. When in the unlatched position, the latch member frictionally engages the bit to inhibit inadvertent discharge of the bit, while permitting intentional insertion and removal of the bit.

3 Claims, 5 Drawing Figures

LATCHING MECHANISM FOR RECIPROCATING IMPACT TOOLS

BACKGROUND OF THE INVENTION

This invention relates generally to improved latching mechanisms for retaining bits in impact type tools. More particularly, this invention relates to an improved latch for an impact tool that inhibits the inadvertent discharge of a bit therefrom when in the unlatched position.

One example of a similar latch is described in U.S. Pat. No. 2,716,393, issued Aug. 30, 1955 to H. R. Fischer. While the latch shown therein is very effective to retain the bit in the tool when in the latched position, the latch is arranged to move to a position where it cannot engage the bit when rotated to the unlatched position. Movement of the latch in this manner facilitates removal and insertion of bits, but the lack of engagement with the bit in the unlatched position can result in the inadvertent, and possibly dangerous, discharge of the bit if the operator fails to rotate the latch to the latched position prior to operating the tool.

An object of this invention is to provide an improved latch for retaining bits in impact type tools. Another object of this invention is to provide an improved latch that positively retains a bit in an impact type tool when in the latched position and that inhibits the discharge of the bit in the event the tool is operated with the latch in the unlatched position.

This invention provides an improved latching mechanism for retaining a bit in an impact-type tool that includes a nose portion having a longitudinally extending opening for receiving the bit and a radially disposed port intersecting the opening, the improvement comprising a latch member extending through the radial port for engaging the bit, the latch member being rotatable therein between latched and unlatched positions; and, resilient means located on the nose portion in engagement with the latch member for preventing inadvertent movement of the latch member from one position to the other and for urging the latch member into frictional engagement with the bit when the latch member is in the unlatched position.

BRIEF DESCRIPTION OF THE DRAWING

The foregoing and additional objects and advantages of the invention will become more apparent as the following detailed description is read in conjunction with the accompanying drawing wherein like reference characters represent like parts in all views and wherein.

DETAILED DESCRIPTION OF THE PREFERRED EMBODIMENT

Figure 1:
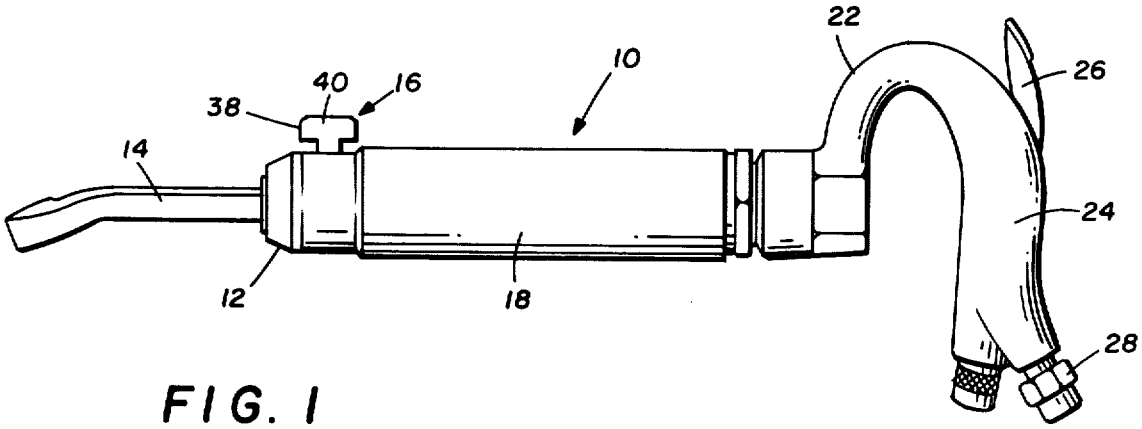
FIG. 1 is a pictorial view of an impact-type power tool that includes a latching mechanism constructed in accordance with the invention.

Referring to the drawing and to FIG. 1 in particular, shown therein and generally designated by the reference character 10 is a pneumatically powered impact tool. The tool 10 includes a nose 12 for receiving a bit 14 (illustrated as being a chisel), a latching mechanism 16 for retaining the bit 14 in the nose 12, a power cylinder 18 having a reciprocating hammer 20 (see FIG. 2) located therein, and a handle assembly 22.

The handle assembly 22 includes a gripping portion 24, a trigger 26 and, at the extreme end thereof, a fitting 28 for connecting the air supply to the tool 10.

Figure 2:
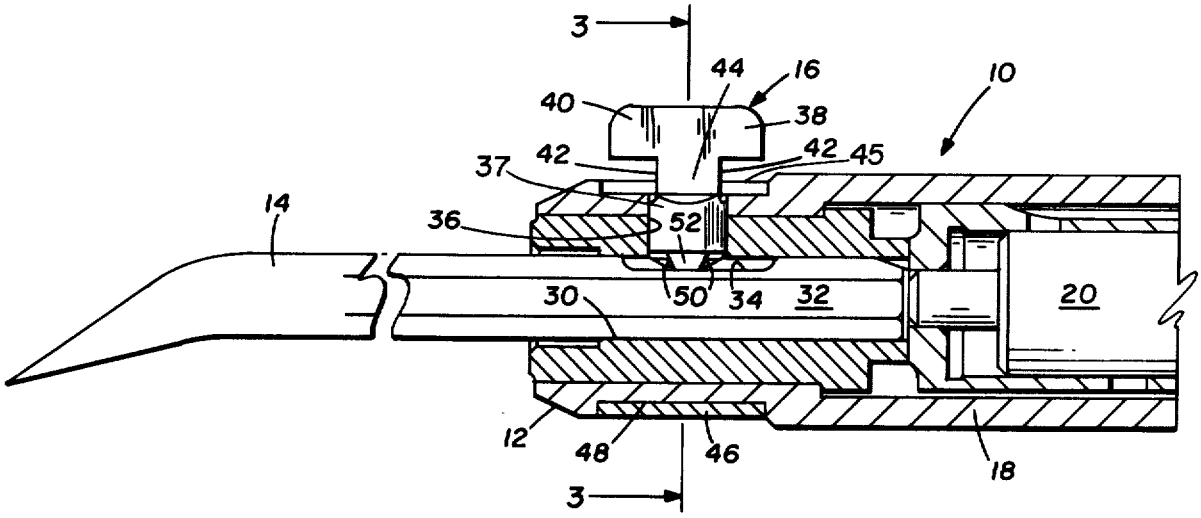
FIG. 2 is an enlarged, cross-sectional view of a portion of the tool of FIG. 1 illustrating the latching mechanism in the latched position and in more detail.

As can be seen in FIG. 2, the nose 12 has an opening 30 extending longitudinally of the tool 10 for slidingly receiving a shank 32 of the bit 14. As illustrated, the shank 32 is octagonal in cross-section (see FIG. 3) and the opening 30 is formed accordingly. The shank 32 may also be of the standard square cross-section if desired. In either case, a latch recess 34 having rather abrupt ends is formed along a portion of the exterior of the shank 32.

The nose 12 also has a radially oriented port 36 that extends therethrough intersecting the opening 30. The port 36 is sized to receive a generally cylindrical portion 37 of a latch member 38 that is rotatable in the port 36 between latched and unlatched positions as will be explained.

Figure 3:
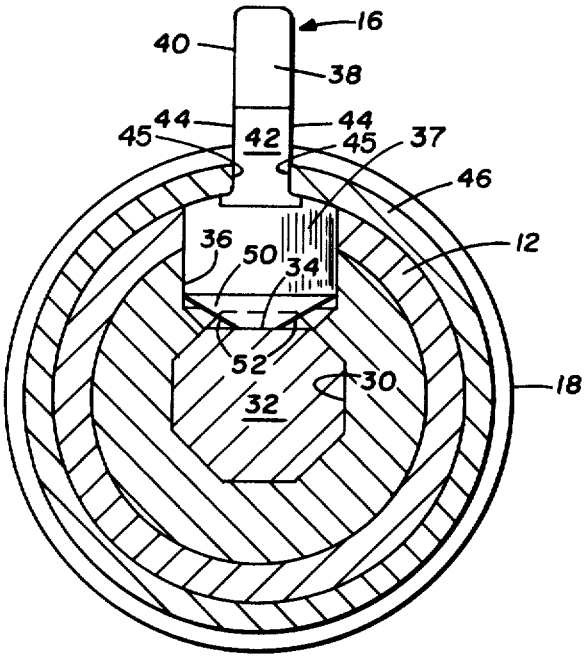
FIG. 3 is an enlarged, transverse, cross-sectional view taken substantially along the line 3—3 of FIG. 2.
Figure 5:
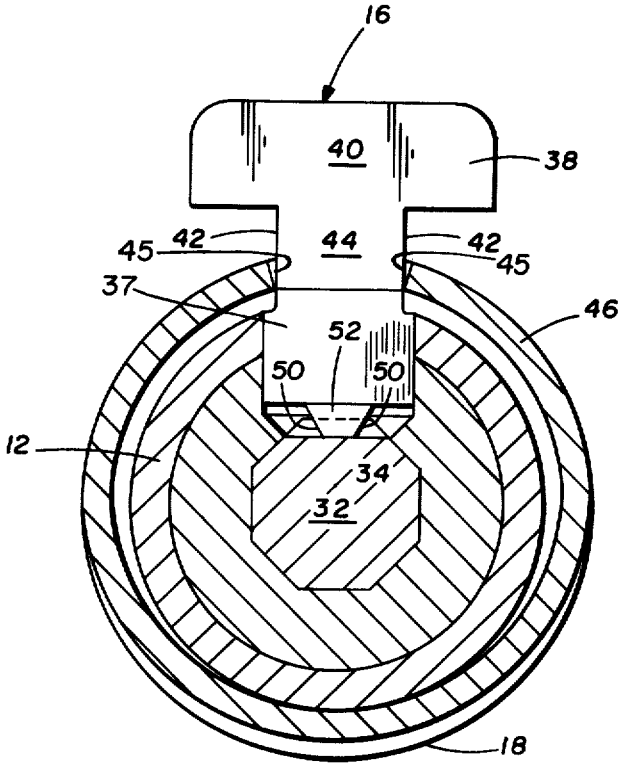
FIG. 5 is a view taken substantially along the line 5—5 of FIG. 4.

The end of the latch member 38 outside the nose 12 is formed into a rectangular gripping portion 40 and between the portion 40 and cylindrical portion 37 is a rectangular portion providing short surfaces 42 and long surfaces 44. The surfaces 42 and 44 in the unlatched and latched positions respectively, are in engagement with the flat ends 45 of a split spring 46 that is disposed in a recess 48 formed in the exterior of the nose 12. The split spring 46 overlies part of the cylindrical portion of the latch member 38 thus retaining the latch member 38 in the port 36. Also, the flat ends 45 of the spring 46 engage the short surfaces 42 as shown in FIG. 5 to retain the latch member 38 in the unlatched position. The flat ends 45 engage the long surfaces 44 as shown in FIGS. 2 and 3 to retain the latch member 38 in the latched position.

Referring again to the construction of the latch member 38, it can be seen that the end thereof that is disposed in the opening 30 is provided with angularly disposed latch surfaces 50 that are on sides corresponding to the short surfaces 42. The latch surfaces 50 are disposed at a large angle (about 60 to 70 degrees) relative to the axis of the tool 10 so that, upon engagement with the ends of the latch recess 34, the latch member will not be forced upwardly and the longitudinal or reciprocating movement of the bit will be limited thereby. It should also be pointed out that the length of the latch member 38 is selected so that any downward force exerted by the spring 46 on the latch member 38 is not imposed on the shank 32 leaving the bit 14 free to reciprocate within limits.

Cam surfaces 52 are provided on the inner end of the latch member 38 also, but on sides thereof corresponding to the long surfaces 44. The cam surfaces 52 are disposed at a relatively flat angle (about 20 to 30 degrees) with respect to the axis of the tool 10 so that they cooperate with the ends of the latch recess 34 to force the latch member 38 upwardly. Accordingly the bit 14 can be inserted and removed when desired provided that the latch member 38 is in the unlatched position.

OPERATION OF THE PREFERRED EMBODIMENT

When it is desired to operate the tool 10, the latch member 38 is rotated to the unlatched position. A bit 14, which is selected according to the job to be performed, is then positioned with the end of the shank 32 in the entrance to the opening 30 in the nose 12. The bit 14 is inserted into the opening 30 until the end of the shank 32 engages one of the surfaces 52 on the latch member 38. Since the split spring 46 is exerting a downward force on the latch member 38 sufficient force must be exerted on the bit 14 in an axial direction to cam the latch member 38 upwardly and move the shank axially in the opening 30 until the latch member 38 drops into the latch recess 34 under the influence of the spring 46. It should be pointed out that the latch member 38 will remain in the unlatched position, freeing the operator's hands to insert the bit 14, because the flat ends 45 of the spring 46 are in engagement with the short surfaces 42 on the latch member 38.

Figure 4:
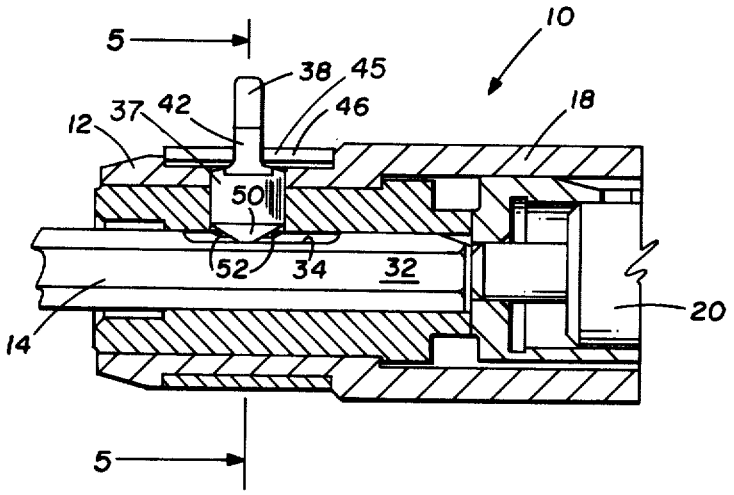
FIG. 4 is a view similar to FIG. 2, but showing the latching mechanism in the unlatched position.

Should the operator fail to rotate the latch member 38 to the latched position before actuating the trigger 26 to place the tool 10 in operation, the bit 14 will not be discharged from the tool 10 or, if discharged, its velocity will be sufficiently low to prevent damage. With the latch member 38 in unlatched position, and the tool 10 started, the hammer 20 may strike the end of the shank 32 driving the bit 14 to the left as seen in FIG. 4. Inhibiting the discharge of the bit 14, is: the frictional engagement of the end surface of the latch member 38 in the recess 34 caused by the spring 46; the engagement between one of the surfaces 52 with the end of the latch recess 34 and the increased force exerted by the spring 46 resisting the upward movement of the latch member 38; and the continued, increased frictional force between the end of the latch member 38 and the outer surface of the shank 32.

Numerous tests run on the tool 10 with the latch member 38 in the unlatched position, failed to discharge the bit 14. However, with all circumstances exactly right, it would be theoretically possible to discharge the bit, but, as can be appreciated, the frictional forces exerted will absorb considerable energy so that the bit 14 cannot be discharged with sufficient velocity to be a hazard.

Normally, the operator, after insertion of the bit 14, will grasp the gripping portion 40 of the latch member 38 and rotate the latch member 38 by overcoming the force of the spring 46 from the unlatched position illustrated in FIGS. 4 and 5 to the latched position illustrated in FIGS. 2 and 3. When rotated approximately 90°, the flat ends 45 of the spring 46 are in engagement with the long surfaces 44 on the latch member 38, positively retaining the latch member 38 in the latched position.

As illustrated, one of the surfaces 50 is positioned to engage the end of the recess 34 at such an angular relationship that the outward movement of the bit 14 will be stopped. Also, and as previously mentioned, the bit 14 is free to reciprocate because the latch member 38 is not in engagement with the shank 32, except to stop the axial movement.

With the latch member 38 in the latched position, the operator places the cutting end of the bit 14 against the work which presses the bit 14 inwardly into a position for engagement between the hammer 20 and the end of the shank 32. Actuation of the trigger 26 causes, by means old in the art, reciprocation of the hammer 20 which strikes the end of the bit 14 driving the bit 14 toward the work. The bit 14 returns due to rebound off the work or due to continual forward pressure exerted by the operator.

Removal of the bit 14 is accomplished by rotating the latch member 38 to the unlatched position and exerting sufficient outward force thereon to overcome the frictional forces between the latch member 38 and the bit shank 32.

From the foregoing description, it can be appreciated that an improved latching mechanism, constructed in accordance with the invention, provides a means of positively retaining a bit in the tool when in the latched position. Further, such a latching mechanism inhibits, if not prevents, the inadvertent discharge of a bit from the tool when in the unlatched position while permitting insertion and removal when desired.

The detailed description of the preferred embodiment is presented by way of example only, and it will be understood that many changes and modifications can be made thereto without departing from the spirit of the invention.

The embodiments of the invention in which an exclusive property or privilege is claimed are defined as follows:

1. An improved latching mechanism for retaining a bit, such as a chisel, scaler, chipper or the like in impact-type, power tools that include a nose portion having a longitudinally extending opening sized to slidably receive the shank of the bit wherein the shank of the bit has a longitudinally extending latch recess along an intermediate part of one side and the nose portion also has a radial port intersecting the opening, the improvement comprising:

a latch member extending through the radial port and rotatable therein between latched and unlatched positions, said latch member having a gripping portion on a first end disposed outside the nose and a bit engaging portion on a second end disposed inside the opening in the nose portion, said bit engaging portion having first surface means engageable with the bit when said latch member is in the latched position for preventing removal of the bit from the nose while permitting limited reciprocating movement of the bit and second surface means frictionally engaging the bit when said latch member is in the unlatched position for inhibiting the inadvertent discharge of the bit from the opening while permitting intentional insertion and removal of the bit; and resilient means located on the nose portion in engagement with said latch member for preventing inadvertent movement of said latch member from one position to the other and for resiliently urging said latch member into frictional engagement with the bit when said latch member is in the unlatched position.

2. The improved latching mechanism of claim 1 wherein:

said resilient means includes a split ring formed of spring material, said split ring encircling the nose portion and having confronting, generally parallel, flat end faces; and said handle portion includes a portion of generally rectangular configuration providing two relatively long generally parallel faces that are in engagement with the end faces of said split ring when said latch member is in the latched position and two relatively short generally parallel faces that are in engagement with the end faces of said split ring when said latch member is in the unlatched position.

3. The improved latching mechanism of claim 2 wherein:

said first surface means includes a surface on the opposite sides of the bit engaging portion of said latch member and on the same sides thereof corresponding to said short faces for engaging the ends of the recess in the bit to limit longitudinal movement of the bit when the latch member is in the latched position; and said second surface means includes a surface on the opposite sides of the bit engaging portion of the latch member and on the same sides thereof corresponding to said long faces for camming said latch member outwardly of said port to permit removal of said bit and an end surface thereon disposed generally parallel to the axis of the opening for frictionally engaging the bit to inhibit inadvertent discharge of the bit from the tool if said tool is operated with the latch member in the unlatched position.

* * * * *